United States Patent [19]

Vincent

[11] 4,454,859

[45] Jun. 19, 1984

[54] COLLAPSIBLE BURNER SUPPORT APPARATUS

[76] Inventor: Floyd Vincent, Rte. 2, Box 66 M, Kaplan, La. 70548

[21] Appl. No.: 290,378

[22] Filed: Aug. 5, 1981

[51] Int. Cl.[3] ..... F24C 5/20; F16M 11/38

[52] U.S. Cl. ..... 126/38; 248/188.6; 126/40

[58] Field of Search ..... 126/40, 9 R, 38, 37 B, 126/333; 431/343; 108/122, 38; 354/293; 248/167, 188.6, 188.7, 528

[56] References Cited

U.S. PATENT DOCUMENTS

| | | | |
|---|---|---|---|
| 166,767 | 8/1975 | Gorham | 248/167 |
| 1,289,219 | 12/1918 | Marsh | 248/167 |
| 3,797,476 | 3/1974 | Tarcici | 126/424 |
| 4,177,790 | 12/1979 | Zenzaburo | 126/38 |
| 4,226,255 | 10/1979 | Tarrer | 126/9 R |

FOREIGN PATENT DOCUMENTS

| | | | |
|---|---|---|---|
| 433984 | 11/1911 | France | 126/38 |
| 855079 | 2/1940 | France | 126/38 |

*Primary Examiner*—Samuel Scott
*Assistant Examiner*—G. Anderson
*Attorney, Agent, or Firm*—Keaty & Keaty

[57] ABSTRACT

A collapsable burner support apparatus having a vertically disposed hub member. The member having a flow conveying opening through its entire length, a plurality of leg members, each of the leg members including a lower foot portion resting on a support surface and an upper portion for supporting a container thereupon, at least two of the leg members rigidly attached to a collar member, the collar member rotatably connected to the hub member for rotating movement about a vertical axis between a support position and a storage position. The apparatus also has a burner means insertible into the opening of the support hub member for injecting gas upward through the upper opening of the support member and a gas supply means connectible between the gas burner means and a gas fuel source. There is also a means for supporting and maintaining a lighter for the apparatus.

1 Claim, 3 Drawing Figures

COLLAPSIBLE BURNER SUPPORT APPARATUS

BACKGROUND OF THE INVENTION

1. Field of the Invention

The present invention relates to an apparatus for supporting container pots or the like, more particularly, the present invention relates to a collapsable support apparatus for container pots and the like which is adapted with a burner for heating the contents of the container.

2. General Background

Numerous types of small heating units such as portable stoves and the like have been developed and marketed for use by campers and other outdoors people. Also, particularly in the area of the United States, where various of seafood is abundant, support apparatuses which also have a heating ability, are constructed for supporting a rather substantial container which would have the ability to boil seafood such as crawfish, crabs, shrimp or the like. In many cases, many of these portable stoves and/or support apparatuses are rigidly constructed so as to properly support the rather substantial weight involved in the large containers for boiling seafood. Therefore, the containers, for the most part, are rather large and cumbersome, and require a substantial amount of space in order to transport them and to set them up for use.

Therefore, there is a need for a support apparatus which has a heating ability, which has both the ability to be collapsable, and therefore easily transportable, yet, when set up, have the necessary strength to support the substantial weight involved in boiling seafood or the like.

Several apparatuses have been patented which are collapsable and have heating ability for pots or the like. U.S. Pat. Nos. 4,092,974 and 4,117,790, both issued to Zenzaburo, entitled "Pocket Camp Stove" would teach the use of a three wire legged member stove unit, wherein the three legs would be equally spaced apart and extend radially outward from a hub member. The gas unit is received within an upwardly directed resource formed in the hub member having a burner head. The wire leg members have lower portions restable on the support surface and upper portions providing a pan support at a level above the burner head. The wire leg members are movable between a folded position and an equally spaced position. These particular patents are addressed primarily to the support of a pan or the like, and is primarily designated as a portable stove. The apparatus as disclosed in the patent would not have the ability to support the substantial weights involved in the support of pots as with the present apparatus, and therefore, would not suit the purpose as with the present invention.

U.S. Pat. No. 3,809,054, issued to Boman, et al entitled "Collapsable Camp Stove", would also involve a collapsable stove having a three point support. In this particular apparatus, two pivotable legs provide two of the points of support for the stove and the fuel container would provide the third point of support. The shortcoming in this particular apparatus is that the substantial weight placed on this particular apparatus may be an extreme hazard in that the stove leg may rupture and would cause severe damage in terms of a fire or explosion. Also, this particular apparatus is primarily geared towards the support of rather small pans and pots and not the substantial weight as would be required in our particular apparatus.

The following patents also teach the use of portable stoves, all of which are rather delicately constructed, and would not serve the purpose or achieve the ends as our particular apparatus. These patents include:

U.S. Pat. No. 166,767—issued to C. I. Gorham entitled "Nursery Lamp".

U.S. Pat. No. 165,444—issued to C. I. Gorham, et al entitled "Nursery Lamp".

U.S. Pat. No. 1,508,470—issued to A. Patmann entitled "Stand".

U.S. Pat. No. 1,931,584—issued to L. W. Luff entitled "Boiler Stand".

U.S. Pat. No. 3,900,281—issued to Penberthy entitled "Backpacker's Stove".

GENERAL DISCUSSION OF THE PRESENT INVENTION

The present invention would solve the problems and shortcomings in a simple, inexpensive and straight forward manner. The present invention would provide for a collapsable burner and container support apparatus having a centrally elongated vertically aligned hub member with a plurality of leg members, at least two of which are pivotably connected to the hub member for pivotal movement around a vertical axis between a support position wherein each of the legs extends radially outward from the hub member to a storage position wherein each of the leg members are disposed substantially against the other leg members in a relatively flat, juxtaposed position. The pivotal connection between at least two of the leg members and the hub member is via a metal collar which is rigidly attached to each of the pivoting leg members and able to rotate around the exterior of the hub member, the lower portion of the hub member having a retainer ring for the support of the collar members and the upper portion of the hub member having a second retainer ring for attachment to at least one rigidly attached support leg. Each of the leg members of the apparatus would include a lower foot portion restable on a support service and an upper pot or container support portion. Also provided is a gas burner nipple positioned within the hub member at a level below the level of the pot support portions of the leg members and a gas supply conduit having an outlet connectable to the burner nipple and an inlet adapted to receive gaseous fuel from a remote, volumetrically regulated source of gaseous fuel under pressure. The pivotal legs are angularly attached to each of the respective collar members so that rotation of the legs in the folded position would allow the three legs to juxtapose themselves adjacent to one another for easy storage.

Therefore, it is an object of the preferred embodiment of the apparatus of the present invention to provide a collapsable support apparatus for supporting heavy containers or the like.

It is a further object of the preferred embodiment of the apparatus of the present invention to provide a support apparatus having a burner unit for heating a container supported thereon.

It is a further object of the preferred embodiment of the apparatus to provide a collapsable support apparatus, wherein at least two of the legs are supported or pivotably supported to a hub member via a rigid collar means.

It is still a further object of the apparatus of the present invention to provide a collapsable burner unit having a means for receiving a lighter or the like to prevent loss or misplacement of the lighter assembly.

It is a further object of the apparatus of the present invention to provide an apparatus which in the folded state would be easily carried and utilized little space in storage.

BRIEF DESCRIPTION OF THE DRAWINGS

For a further understanding of the nature and objects of the presentinvention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
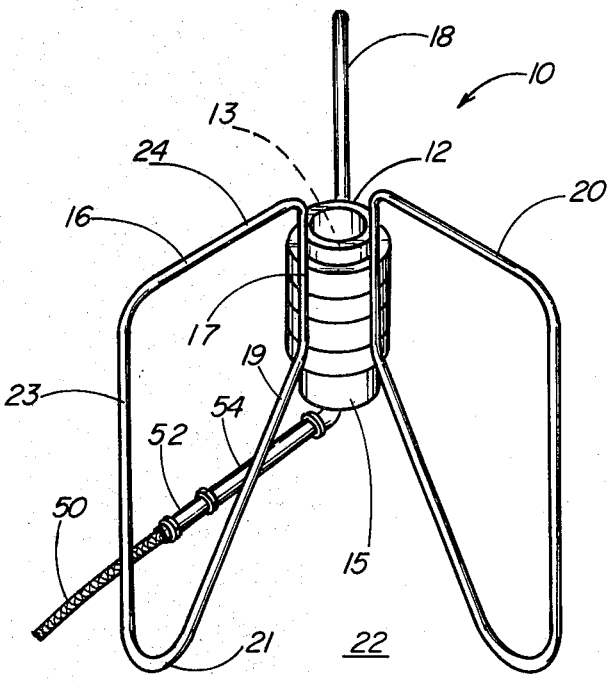
FIG. 1 is a perspective view of the preferred embodiment of the apparatus of the present invention.
Figure 2:
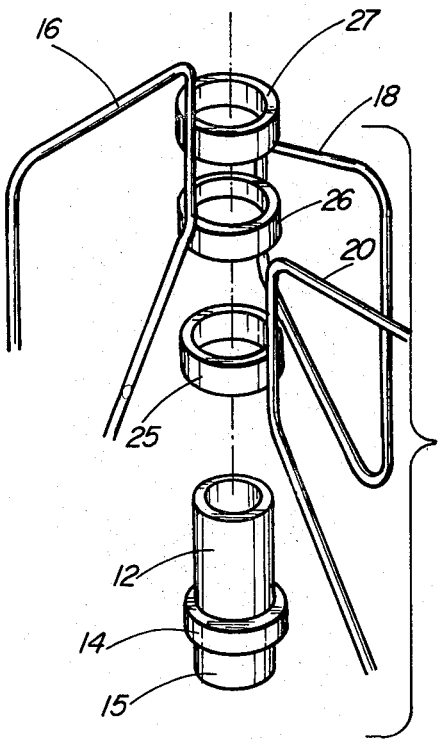
FIG. 2 is a partial perspective view of the preferred embodiment of the apparatus of the present invention illustrating the hub member and collar members in a disassembled manner.

FIG. 1 best illustrates the preferred embodiment of the apparatus of the present invention generally designated by numeral 10. In the preferred embodiment apparatus 10 would be comprised of a vertically disposed, elongated hub member 12, having a opening 13 there through for the flow of gas during the use of the apparatus. Hub member 12 would be essentially a section of rigid pipe or the like, and, in the preferred embodiment would be approximately 4 to 6" in length and having an O.D. of approximately 1 to 2". As seen in FIGS. 1 and 2, at the lower portion of hub member 12 is retainer ring 14 which would be rigidly attached to the exterior of hub member 12 with welding or the like, and would serve to support the leg collar members of the apparatus when the apparatus is in the supportive position. That section of the hub member 12 below retainer ring 14 as designated by member 15 would be slightly tapered for receiving gas burner nipple, as illustrated in FIG. 1.

In the preferred embodiment, apparatus 10 would further comprise at least three leg members 16, 18 and 20. Although each leg member 16, 18 and 20 are identical in structure, the positioning of each leg member and its attachment in relation to collar 12 is individual, and therefore, each leg member shall be discussed individually, except for the general structure of each. In terms of general structure, each leg member, for example leg member 16, would comprise a continuous metal tube, or bar having an interior or vertically disposed section 17 for attachment to a collar portion, the vertical section angulating into angularly disposed section 19 extending from the lower portion of vertical section 17 and outward to the foot portion 21 of leg 16. Foot portion 21 is simply that portion of the leg member making contact with surface 22, such as a ground or the like and would simply comprise a bend in leg 16 to second exterior vertical section 23 which would serve as the outer support member of each leg of the apparatus, the exterior support member 23 under going a right angle bend to horizontally disposed top portion 24, which for each leg member would serve as the pan, pot or container support means for the apparatus. Horizontally disposed section 24 would then continue to integral attachment to the upper part of interior vertically disposed section 17, to form the continuous leg member, in this case leg member 16. This configuration of each leg member 16, 18 and 20 is identical, and for each leg member shall not be discussed individually.

However, it is crucial to the invention that the relationship of each leg member attaching to the hub member 12 is properly defined. As seen in FIGS. 1 and 2, leg member 20 would have interior vertical portion 17 rigidly attached to collar 25 via welding or the like with collar 25 being attached to approximately ⅓ down the length of interior vertically extending section 17 it should be noted that leg member 20 would be preferably attached to collar 25 at an angle other than 90° angle in relation to a tangent to collar 25. The purpose of such an arrangement will be explained hereinafter. For the purpose of this apparatus, each collar 25, 26 and 27 are identical in construction, and would be essentially the same type of metal and shape as is retainer ring 14 as previously discussed.

In the preferred embodiment, collar member 25 would slide rotatably onto hub member 12, and have the ability to rotate around the exterior of hub member 12 and yet be disallowed from sliding from the lower portion of hub member 12 by retainer ring 14, and would simply slidingly mate with retainer ring 14 in the preferred embodiment.

Likewise, leg member 18 would be rigidly attached to collar member 26, with the attachment between leg member 18 and collar 26 being somewhat higher, so that the position of collar 26 slightly above the collar 25, would allow the upper portion 24 of leg member 18 to be of equal height as the upper portion of leg member 20 and 16 so that the apparatus will be maintained level.

Therefore, in the preferred embodiment, leg members 20 and 18 would have the ability to rotate via collars 25 and 26, respectively around the exterior of hub member 12 for storage of the apparatus. In completion of the placement of the legs, leg member 16, which is also rigidly attached to collar 27, would be placed as the very top most collar around hub member 12. In this case, however, collar 27 would be rigidly attached to hub member 12 with welding and the like so that leg member 16 would not have the ability to rotate, and collar 27 would serve as an upper retainer ring of the apparatus, therefore retainer ring 14 and collar member 27 serving to maintain collars 26 and 25 although rotatable within the length of hub member 12. such design prevents collars 25 and 26 from vertical sliding movement along the hub member body.

Figure 3:
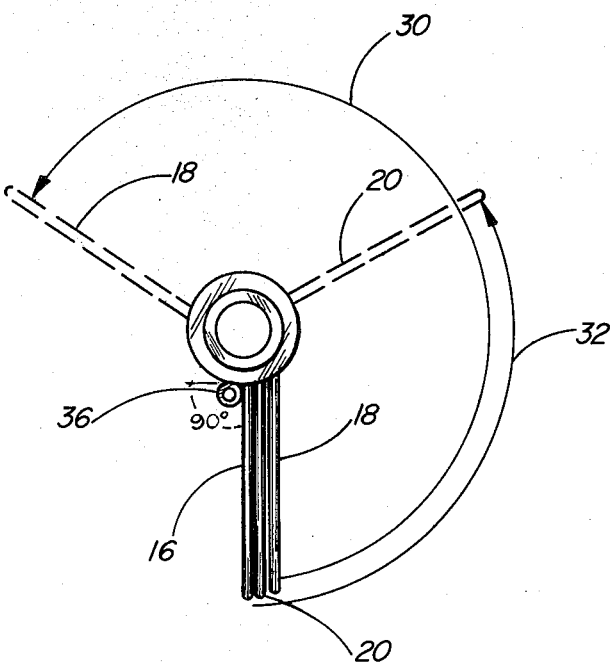
FIG. 3 is a top view of the preferred embodiment of the apparatus of the present invention illustrating the rotatable ability of the leg members around the hub member.

FIG. 3 would illustrate in top view the rotatable ability of leg members 18 and 20 in the preferred embodiment. As can be seen in FIG. 3, arrow 30 would represent the movement of leg member 18 from the closed position as seen in full view, to the open position as seen in phantom view in FIG. 3. Likewise arrow 32 would illustrate the movement of leg member 20 from the closed position in full view to the open position in phantom view. Also ilustrated in FIG. 3 is leg member 16 which, as previously discussed, would not have the rotating ability, but would simply be fixedly attached via collar member 27 onto hub member 12 for a stationary position of leg member 16.

Of course, in the preferred embodiment, the relative rotation of leg members 18 and 20, these would be the position of leg member 16 should be such that approximately 120 degrees is maintained between each leg member for proper support of the apparatus during use.

Also illustrated in FIG. 2 is the position at which each respective leg members 16, 18 and 20 are rigidly connected to each of the respective collar members 27, 26 and 25. As is illustrated in FIG. 2, leg member 16 is connected to collar 27 at substantially a 90 degree angle outward from collar 27. Leg member 20, as illustrated in FIG. 3 is rigidly attached to collar member 25 at an angle away from the 90 degree angle, as is leg member 18 attached to collar member 26, the result being that the three legs 16, 18 and 20 in the closed position are allowed to align themselves face to face, for a more confined storage area.

As is illustrated in FIG. 3, leg 18 is positioned substantially away from the right angle as is leg 16.

Also illustrated in FIG. 3 is holder ring 36, which would simply be a metal ring or the like for containing a metal lighter apparatus or the like while the apparatus is being transported from area to the next, so that the lighter apparatus is not advertently left behind. Also, the lighter apparatus could be attached to the support apparatus via a wire or the like, so that while not in use the lighter apparatus would not be forgotten on the scene after the apparatus has been utilized then stored away.

FIG. 1 also illustrates a gas line 50 which would extend from the distal end of the apparatus through a tank or the like source of gas to the end proximate the apparatus to connection member 52. Connection member 52 would threadably connect to nipple section 54 which is simply a pipe or the like having a curved nipple end extending upward into hub member 12. The nipple would of course have a port in its end for the release of gas when the flow would be allowed. Therefore, hub member 12 would serve as a flow area for the gas as it moved upward through hub member 12. Upon the ignition of gas by a lighter or thelike, the gas would burn in a substantial flame above the top portion of hub member 12 and would of course deliver substantial heat to a container which would be supported on legs 16, 18 and 20. Of course the substantial opening in hub member 12, would allow air to flow upward with the gas for the necessary oxygenation of the gas during the burning process.

Upon discontinued use of the apparatus, legs 18 and 20 would simply be rotated from the open position as seen in phantom and FIG. 3 to the closed position as also seen in FIG. 3 for easy storage of the apparatus. Again, the angulation of the legs as attached to their respective collar members would enable the three leg members 16, 18 and 20 to juxtapose themselves against one another for a more confined storage position as seen in FIG. 3.

In the preferred embodiment, apparatus 10 would be constructed of a high grade metal for having adequate support ability for the large containers for which this apparatus is suited. The attachment between the retainer members with the hub member and the legs to the collar members would be sufficient welding or the like for a rigid and firm connection for proper support. The legs would be constructed of a $\frac{1}{4}''$ solid metal bars which would simply be bent to the angulated configuration as seen in the drawings.

In the preferred embodiment, gas line 50 would lead to a gas fuel source, such as propane or butane, and would, preferably, attach to the fuel source via an O-ring on the valve body, thus requiring no tools for attachment thereto and easy disconnection. Also, the control valve for the fuel would be at the attachment point between the fuel tank and line and the O-ring valve, so that fuel is not maintained in the line under pressure when the valve is closed.

Because many varying and different embodiments may be made within the scope of the inventive concept taught herein, and because many modifications may be made in the embodiments herein detail in accordance with the descriptive requirement of the law, it is to be understood that the details herein are to be interpreted as illustrative and not in a limiting sense.

What is claimed as invention is:

1. A collapsable burner support apparatus, comprising:

a. a substantially cylindrical elongated burner support hub member, said member vertically disposed during operation and having a central fuel gas conveying port therethrough;

b. a plurality of collar members disposed around substantially the entire length of said support hub member, the lowermost and uppermost of collar members being rigidly attached to said hub member and the collar members therebetween being rotatably moveable about a vertical axis around said support hub member;

c. at least three leg members, two of which are rigidly attached to rotatable collar members, for moving between a radially outwardly support position to a storage position, and said third leg member rigidly attached to at least one of said rigidly attached collar members, each of said leg members including a lower foot portion resting on a support surface and an upper support portion for supporting a container or pot thereon;

d. wherein at least two of said leg members are attached to said collar members at an angle other than a 90° angle to the tangent to said collar members, so that said leg members are disposed substantially against the other leg members in a relatively flat, juxtaposed relationship when said apparatus is in a storage position;

e. a gas burning unit, said unit comprising:

i. a gas supply conduit having an outlet in connectable to said burner unit and an inlet being adapted to receive gaseous fuel from a source under pressure;

ii. a gas injecting nipple portion insertible into said gas conveying opening in said hub member, said nipple conveying gas out of the top of said hub member during use of said apparatus.

* * * * *